US005132500A

United States Patent [19]

Clew

[11] Patent Number: 5,132,500

[45] Date of Patent: Jul. 21, 1992

[54] DIFFERENTIAL PRESSURE SWITCH WITH SEALED CONTACTS

[75] Inventor: Nicholas R. Clew, Deerfield Beach, Fla.

[73] Assignee: Micro Pneumatic Logic, Inc., Fort Lauderdale, Fla.

[21] Appl. No.: 653,677

[22] Filed: Feb. 11, 1991

[51] Int. Cl.[5] ..... H01H 35/34

[52] U.S. Cl. ..... 200/83 P; 73/723; 200/83 Y

[58] Field of Search ..... 73/716, 717, 723; 307/118; 340/611, 626; 200/83 R, 83 A, 83 J, 83 S, 83 SA, 83 P, 83 Y, 81.4, 302.1

[56] References Cited

U.S. PATENT DOCUMENTS 3,423,552 1/1969 Sipin .
3,752,942 8/1973 McAfee .
4,081,636 3/1978 Rice ..... 200/83 Y
4,190,752 2/1980 Rogers .
4,277,227 7/1981 Jenkins .
4,433,219 2/1984 Dietz .
4,469,923 9/1984 Charboneau .
4,503,301 3/1985 Kurtz ..... 200/83 D
4,692,574 9/1987 Berkhof .
4,743,716 3/1988 Tsukioka ..... 200/83 Y
5,001,317 3/1991 Atkinson ..... 200/302.1

FOREIGN PATENT DOCUMENTS 1195626 11/1959 France ..... 200/83 Y

*Primary Examiner*—Gerald P. Tolin
*Attorney, Agent, or Firm*—Lewis H. Eslinger; Jay H. Maioli

[57] ABSTRACT

A differential pressure switch has a main switch body divided into three chambers by means of two diaphragms, thereby sealing the center chamber that contains a snap-action switch. The two diaphragms are mechanically connected by a strut that can move only along a single line of motion, so that movement of one diaphragm is transmitted to the other. Movement of the strut is coupled to an actuator of the snap action to produce the desired switching action.

17 Claims, 3 Drawing Sheets

DIFFERENTIAL PRESSURE SWITCH WITH SEALED CONTACTS

BACKGROUND OF THE INVENTION

1. Field of the Invention

This invention relates generally to pressure switches and, more particularly, to a pressure switch for sensing a differential between two pressures and actuating switch contacts in response thereto.

2. Description of the Background

The usefulness of a differential pressure switch is quite well-known. Such switches generally sense gauge or differential vacuums or pressures and include electrical switch contacts that are operated when the sensed pressures exceed preset levels.

Generally, a differential pressure switch employs a diaphragm that is driven in one direction or the other based upon the pressure differential existing across the diaphragm. Typically, a number of springs and switches are employed and the differential pressure switch can become quite complex in construction. Part of the complexity is due to a desirability to isolate the switch contacts from the fluid whose pressure is being sensed, since quite frequently such fluids are corrosive.

OBJECTS AND SUMMARY OF THE INVENTION

Accordingly, it is an object of the present invention to provide a differential pressure switch that can eliminate the above-noted defects inherent in the previously proposed differential pressure switches.

Another object of this invention is to provide a differential pressure switch with snap-action electrical contacts that are isolated from the fluids whose pressures are being sensed.

A further object of this invention is to provide a differential pressure switch employing two diaphragms that in turn are sealingly engaged with the switch body and serve to isolate the switch contacts from any corrosive fluids that are present.

Yet another object is to provide a differential pressure switch in which the switch contacts are environmentally sealed and are isolated from the ambient atmosphere.

In accordance with an aspect of the present invention a differential pressure switch has a plastic housing that is divided into three separate cavities by means of two flexible diaphragms. The center of the three cavities houses a snap-action switch and the two other outer cavities are connected via ports either to atmosphere or to the pressure or vacuum to be monitored. A strut passes through the center cavity and is attached to both diaphragms. The strut transmits the force on one diaphragm directly to the other and, thus, as the diaphragms move under the influence of pressure so does the strut. The strut has a groove formed thereon to which the strut is attached in order to actuate a snap-action switch, which is located in the center cavity, from one position to another. A spring employed in the snap switch biases the strut in one direction and thereby forms the high and low sides to the differential pressure switch. An additional compression spring is connected to one and of the strut in one of the two outer cavities to provide an adjustable bias that ca modify the bias of the snap-action switch spring and permit a complete range of switch actuation set points.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENTS

The differential pressure switch of the present invention was originally intended for use in determining whether a fan or blower or the like is operating. Nevertheless, this differential pressure switch is also useful in monitoring a pressure drop across an air filter in order to provide an indication that the filter has become blocked or for checking the flue pressure in an air conditioning system, for example.

Although in this embodiment the basic structure of the switch is formed of a plastic housing, various other materials that are generally inert and have structural rigidity could also be employed. Because two diaphragms are employed, the high and low pressure cavities are separated from each other and hence provide a redundant seal. Thus, should one diaphragm leak the switch will still function normally and there will be no mixing of the high and low pressure fluids. Similarly, because of the use of the two diaphragms any pressure change within the center cavity that contains the snap action switch will not affect the pressure switch operation, because such pressure change will act equally on the backs or inner sides of both diaphragms.

Figure 1:
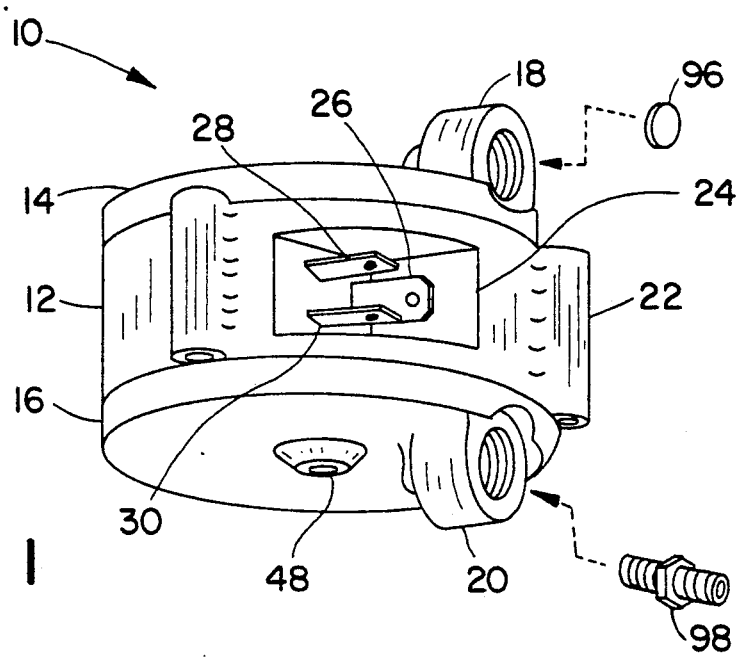
FIG. 1 is a perspective view of an embodiment of a differential pressure switch according to the present invention.

In the differential pressure switch 10 shown in FIG. 1, a housing body 12 is sealingly attached to a top cover 14 and a bottom cover 16. Top cover 14 has a port 18 formed therein and, similarly, bottom cover 16 also has a port 20. The two ports 18, 20 that are connected to the pressure differential are provided in this embodiment with female pipe threads but any suitable adapter or different thread arrangement could be provided. For example, barbed connections could be provided in place of the tapped ports. Housing body 12 and top and bottom covers 14 and 16 are all formed of the same material, which in this embodiment is an inert plastic material such as glass-filled polyester. In this embodiment, the pressure switch 10 may be mounted in the appropriate operating position using bosses, such as shown typically at 22. The electrical terminals for differential pressure switch 10 are provided in a recess 24 formed in housing body 12. The electrical terminals 26, 28, 30 located in recess 24 are connected internally to the snap-action switch contacts, which will be described in detail hereinbelow. By providing the electrical terminals recessed into the side of the housing, it is possible to fill the recess with a potting compound (not shown), thereby to seal the connections after the wiring operation. In addition by recessing the electrical terminals into the body, any possible damage thereto that may occur in packing, shipping, and installation is minimized.

Figure 2:
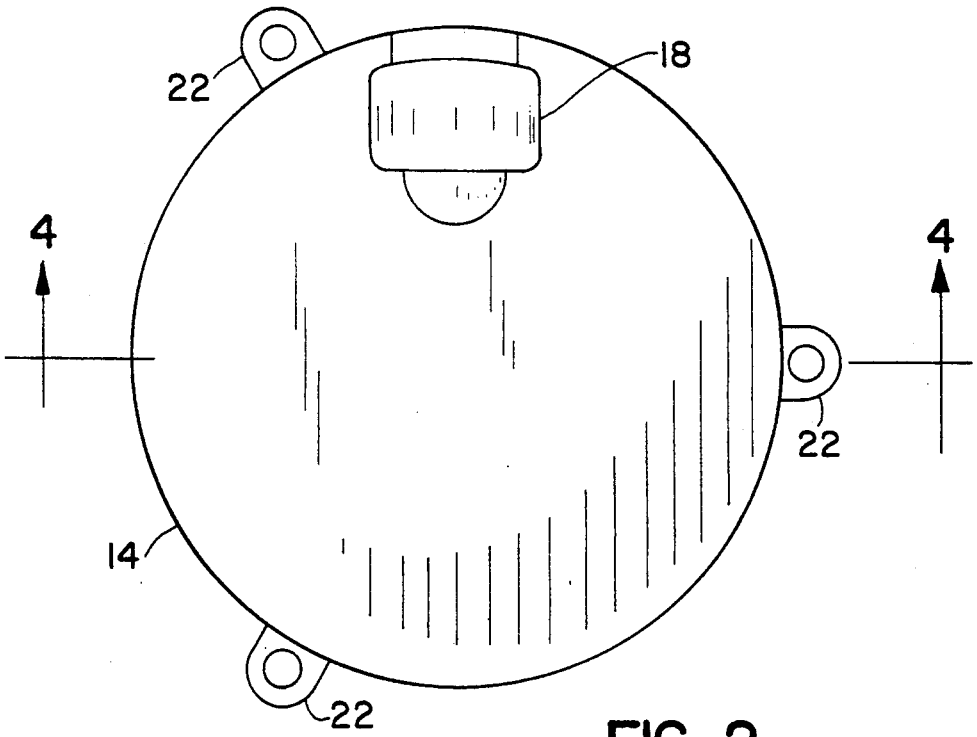
FIG. 2 is a plan view of the embodiment of FIG. 1.

The positioning of top port 18 on top cover 14 is shown more clearly in FIG. 2 in relation to mounting bosses 22. Nevertheless, the position of the top port, as well as that of the bottom port, may be changed depending upon the specific operating and mounting requirements simply by repositioning the top cover 14 or bottom cover 16 in relation to housing body 12.

Figure 3:
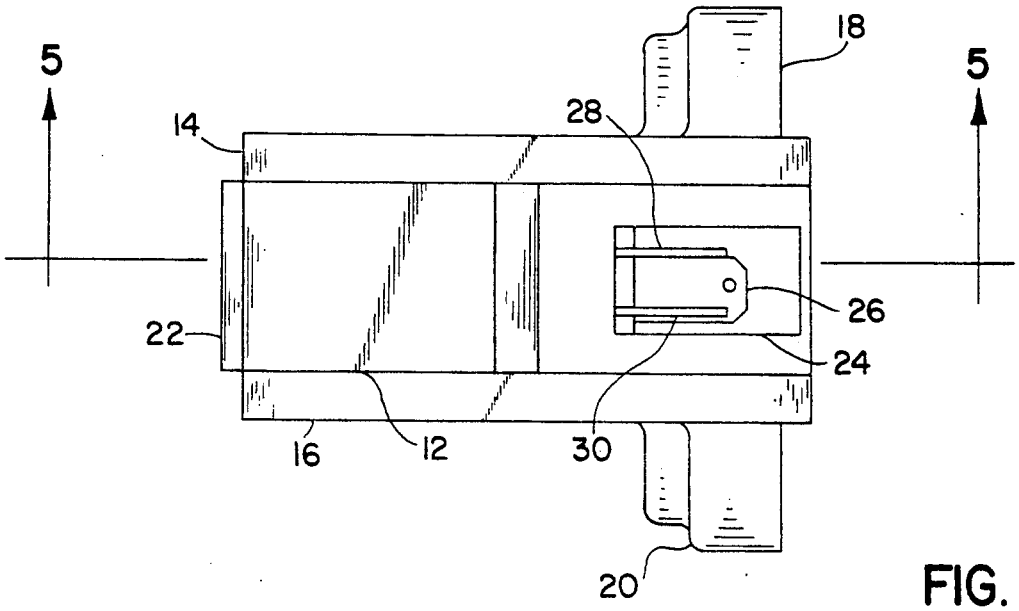
FIG. 3 is a side elevational view of the embodiment of FIG. 1.

In FIG. 3, the arrangement of the terminals 26, 28, and 30 inside recess 24 is shown again in relation to the housing body 12, mounting bosses 22, top port 18, and bottom port 20.

Figure 4:
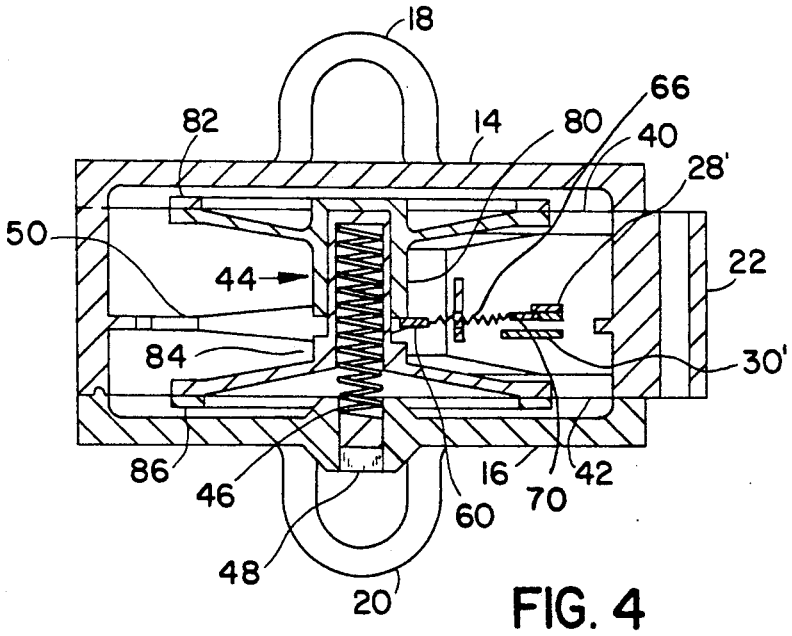
FIG. 4 is an elevational view in cross section taken through section lines 4—4 of FIG. 2.

The elements of the inventive differential pressure switch that are internally arranged are shown in FIG. 4, which is a cross section taken along lines 4-4 in FIG. 2. In FIG. 4 the snap-action switch is shown housed within the center cavity formed in housing body 12. More specifically, a first diaphragm 40 is captured between top cover 14 and an upper edge of housing body 12 and a second diaphragm 42 is similarly captured between bottom cover 16 and a lower edge of housing body 12. A strut assembly 44 passes through the center of housing body 12 and serves to connect mechanically first diaphragm 40 with second diaphragm 42. Because strut assembly 44 is pincipally supported by the two diaphragms 40, 42, there is very little resistance to movement of strut assembly 44. Moreover, there are no sliding or pivoting parts and the related friction is eliminated. A compression spring 46 is arranged between bottom cover 16 and strut assembly 44 in order to further bias the two diaphragms 40, 42 in addition to the bias provided by a spring in the snap-action switch, which will be discussed hereinbelow. A screw 48 is threadedly engaged in the center of bottom cover 16, so that spring 46 is arranged between one end of strut assembly 44 and screw 48. In this manner, the force of biasing spring 46 can be easily adjusted externally of the switch 10 by turning screw 48. For vacuum applications a sealant can be added around screw 48. It is understood, of course, that the high-pressure side of this differential switch 10 is on the diaphragm opposite spring 46, however, spring 46 can be eliminated and all the bias provided by the snap-action return spring for ultra-low pressure applications.

Strut assembly 44 has a ring-shaped groove 50 formed thereon into which an element of the switch assembly fits. The switch assembly will be shown more clearly in FIG. 5. The actual formation of the strut assembly 44 is shown in more detail in FIG. 6, however, it is understood that various kinds of constructions of this strut assembly are possible provided that the two diaphragms remain mechanically connected in such a fashion that the force on one diaphragm is transmitted directed across to the other and so that the movement of the strut is coupled to the snap-action switch mechanism.

Figure 5:
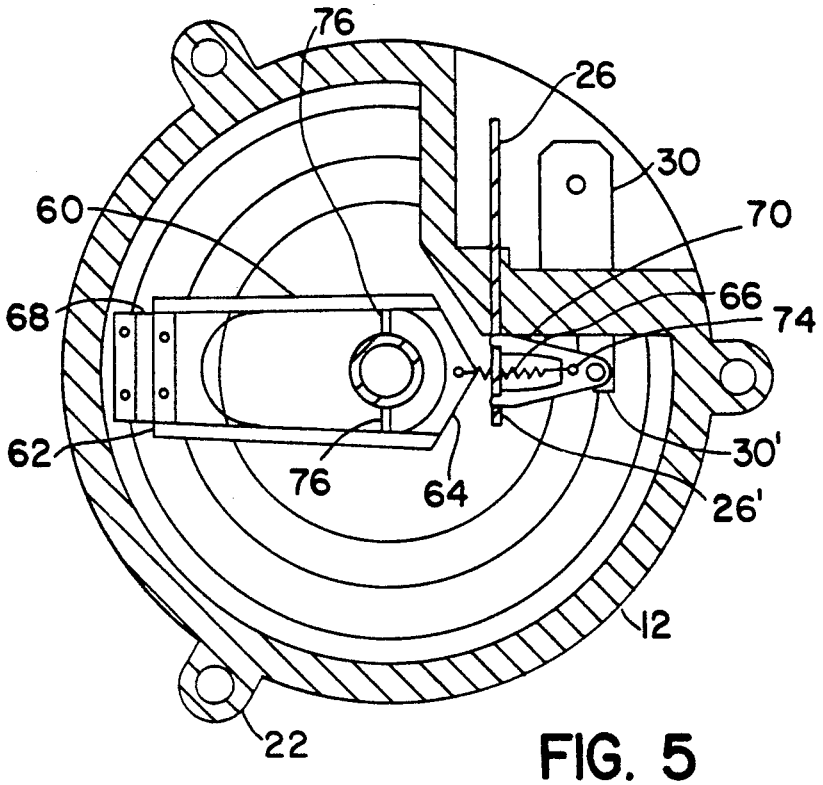
FIG. 5 is a plan view in cross section taken through section lines 5—5 in FIG. 3.

FIG. 5 is a cross-sectional plan view taken through section lines 5—5 in FIG. 3 showing the internal arrangement of the elements of the snap-action switch. More specifically, a paddle element 60 is attached at one end 62 to the housing body 12 and at the other end 64 to a coil spring 66. Paddle end 62 is a&attached to housing body 12 by a thin Kapton hinge 68 that can be insert molded to both housing body 12 and paddle end 62. By using a thin flat hinge, such as at 68, paddle 60 can pivot up and down about hinge 68 quite easily but is prevented from any lateral movement. Paddle end 64 is connected via coil spring 66 to a movable switch arm 70 formed generally in the shape of a yoke or wishbone. Movable switch arm 70 is pivotally attached to one end 26' of electrical terminal 26 that extends from recess 24 through the wall of housing body 12. The pivots of movable switch arm 70 are out of line with paddle end 64 and the attachment point 74 of coil spring 66 to the arm 70. Therefore, snap action is possible upon a short amount of travel of paddle 60 caused by movement of strut assembly 44. This strut movement is transmitted to paddle arm 60 by means of two laterally extending pins 76 that extend from paddle element 60 and that fit into groove 50, shown in FIG. 4, formed in strut assembly 44. These pins 76 have a clearance at their free ends so as fit into grooves 50 without making a tight fit with strut assembly 44, as shown in FIGS. 4 and 6.

The manner in which movable switch arm 70 contacts the two electrical terminals is shown more clearly in FIG. 4, which is a cross-sectional elevation taken along section lines 4—4 in FIG. 2. As shown in FIG. 4, movable switch arm 70 can move at its free end between switch contacts 28' and 30', which are the ends of terminals 28 and 30, respectively, extending through the wall of housing body 12 from recess 24. Also in FIG. 4, the construction of the strut assembly 44 is shown as comprising four parts 80, 82, 84, and 86. More specifically, a strut element 80 is formed as a disc that has a large-diameter, centrally arranged tube 88. Upper diaphragm 40 is shaped as a flat ring and is fixed to element 80 by a ring 82 that is welded or glued to element 80 with the diaphragm captured therebetween. Another strut element 82 is also formed as a disc that has a relatively small-diameter, centrally arranged tube 90 that is tightly fitted into the bore of large tube 84 and a large diameter tubular portion 92 that is generally the same diameter as tube 88. Alternatively, tube 88 can be glued to tube 90. Lower diaphragm 42 is shaped as a flat ring also and is fixed to element 84 by a ring 86 that is glued or welded to element 84 with the diaphragm captured therebetween. B fitting strut elements 80 and 84 together, upper diaphragm 40 and lower diaphragm 42 are mechanically coupled. One end of compression spring 46, which is adjusted by screw 48, fits into the bore of small diameter tube 90.

Figure 6:
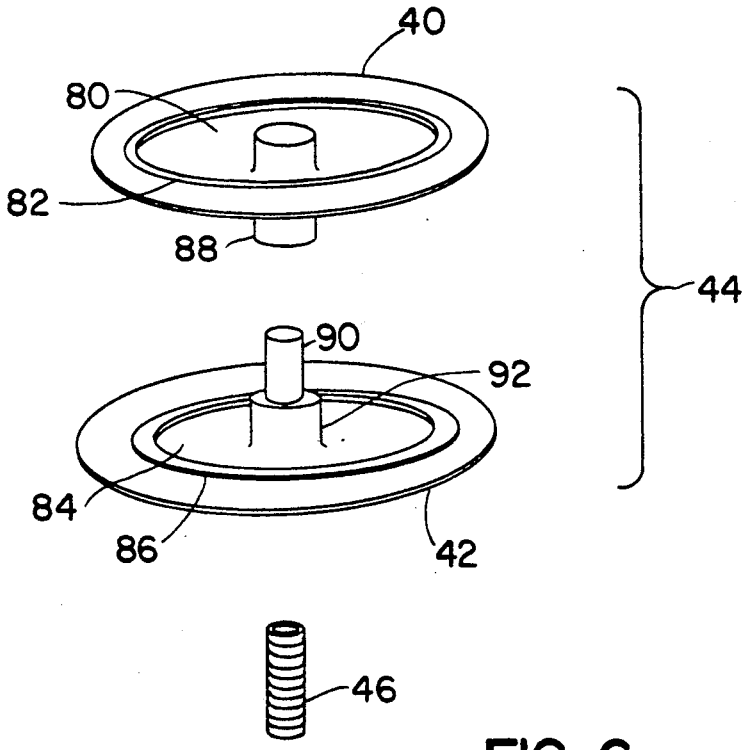
FIG. 6 is a detail showing the assembly of the strut utilized in the embodiment of FIG. 1.

The strut assembly 44 is shown in a partially exploded view in FIG. 6 incorporating upper and lower diaphragms 40 and 42, respectively. As shown therein, diaphragms 40 and 42 are each in the form generally of a flat ring or washer that is attached at its inner periphery to the outer rim of the respective strut element by the respective flat ring. In addition, the manner in which the small tube 90 fits into the bore of the large tube 88 is shown, as is the manner in which compression spring 46 is inserted into the bore of small tube 9 of strut element 84. The free end of spring 46 then rests against the adjustment screw 48 shown in FIG. 4. It has been found that by forming an 0-ring at the inner and outer peripheral edges of the diaphragm and providing a slight groove in the disc and ring, as well as in the housing body and top and bottom covers, that when the plastic parts are welded together the diaphragm is sealingly captured.

As seen in FIG. 4, when the smaller tube 90 is inserted into the larger tube 88 the smaller tube 90 bottoms out so that circular groove 50 is formed by the end of tube 88 and the large diameter portion 92. Then the lateral pins 76 of paddle arm 60, as shown in FIG. 5, will fit into groove 50 between tubes 88 and 92. The pins 76 are biased into contact with one or the other of the sides of groove 50 by means of coil spring 66. This bias can be further adjusted by means of compression spring 46. Thus, when strut assembly 44 is caused to move by a pressure differential across diaphragms 40 and 42, groove 50 will move pins 76 that cause paddle arm 60 to move against the action of coil spring 66 and, once it passes dead center, movable switch arm 70 will snap and the switching action will take place.

Although one feature of the inventive differential pressure switch is to isolate the switch contacts from the environment, alternatively a small hole could be provided in the housing body so that if on of the diaphragms begins to leak the fluid against the leaking diaphragm could be detected coming from such small hole. On the other hand, in the environmentally isolated embodiment, an inert gas, such as argon, could be placed in the housing to prolong contact life.

In addition, in order to prevent pressure pulses in the fluid being monitored from causing switch chatter, a filter could be inserted into the top and/or bottom port. This filter could be tuned to each specific application, for example, leak rates through such filter could be selected between one second and one minute. A suitable material for such filters is sintered metal, such as bronze, brass, or 300-Series stainless steel. The filter could be a small disc that is seated at the bottom of a port, such as represented at 96 relative to top port 18 in FIG. 1.

Also, when the fluid whose pressure is being monitored is flammable and the inventive differential pressure switch is being used in an application requiring a fire-proof switch, in order to prevent the expense of fabricating a fire-proof switch body it is possible to provide a metal fitting with a small orifice in the fluid inlet line. Thus, if the switch body were destroyed by fire the fitting 98 would remain and restrict flow of fluid to the atmosphere. The fitting 98 can have male pipe threads on both ends with the orifice formed by a narrow bore therein, as shown in FIG. 1. The orifice in such a fitting can be on the order of 0.011 inches in diameter.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. A differential pressure switch, comprising:

a substantially cylindrical housing having first and second fluid inlets at closed ends thereof;

a substantially circular first diaphragm sealingly arranged in said housing and forming with one of said closed ends a first chamber in fluid communication with said first fluid inlet;

a substantially circular second diaphragm sealingly arranged in said housing and forming with the other of said closed ends a second chamber in fluid communication with said second fluid inlet;

said first and second diaphragms being relatively arranged in said housing so as to form a third chamber sealed by said first and second diaphragms and located between said first and second chambers;

switch means mounted in said third chamber and selectively interconnecting electrical terminals which are fed through a wall of said housing; and strut means axially aligned in said cylindrical housing and arranged in said third chamber mechanically connecting the centers of said first circular diaphragm and said second circular diaphragm and including means for actuating said switch means upon movement of said first and second diaphragms in response to a fluid pressure between said first and second chambers, wherein switch means comprises an arm member having an open central area through which said strut means passes and being hingedly attached at one end to an inner wall of said housing in said third chamber and at another end to a movable switch contact of said switch means.

2. A differential pressure switch according to claim 1, further comprising a spring arranged in said second chamber biasing said second diaphragm in a direction toward said first chamber.

3. A differential pressure switch according to claim 1, further comprising a recess formed in an exterior wall of said housing containing said electrical terminals of said switch means.

4. A differential pressure switch according to claim 1, wherein said first and second circular diaphragms have respective, central cutout portions attached at the inner peripheries thereof to the outer peripheries of first and second circular hubs, respectively, and wherein said strut means comprises a first tubular element having a closed end attached to the center of said first circular hub and having an open end extending into said third chamber, and a second tubular element having an open end attached to the center of said second circular hub at an aperture formed thereat for communicating with said second chamber and a closed end extending into said third chamber and being fitted into said open end of said first tubular element, whereby said first and second hubs are mechanically connected for movement together.

5. A differential pressure switch according to claim 4, further comprising a compression spring arranged in said second chamber having a first end aubtting one of said closed ends of said housing and a second end abutting said closed end of said second tubular member for biasing said second diaphragm in a direction toward said first chamber.

6. A differential pressure switch according to claim 5, further comprising an adjustment screw threaded through said first closed end of said housing and having said second end of said compression spring abutting an end of said adjustment screw, whereby upon turning said adjustment screw tension in said compression spring is adjusted.

7. A differential pressure switch according to claim 4, wherein said open end of said first tubular element surrounding said second tubular element forms said means for actuating said switch means and said arm member includes at least one pin extending into said open central area thereof and contacting said open end of said first tubular element, whereby motion of said strut means is transmitted to said arm member of said switch means.

8. A differential pressure switch according to claim 7, wherein said arm member is hingedly attached to said inner wall of said housing by a thin, plastic film being substantially coplannar with said arm member.

9. A differential pressure switch according to claim 1, wherein said housing is formed having a central body portion and top cover and a bottom cover forming said closed ends of said housing, with said first diaphragm being sealingly engaged between said top cover and an upper edge of said central body portion and said second diaphragm being sealingly engaged between said bottom cover and a bottom edge of said central body portion.

10. A differential pressure switch according to claim 1, further comprising at least one mounting boss formed on said housing for attaching said differential pressure switch in a mounting position.

11. A differential pressure switch according to claim 1, further comprising a fluid filter inserted into one of said first and second fluid inlets.

12. A differential pressure switch according to claim 11, wherein said fluid filter is formed of sintered metal.

13. A differential pressure switch according to claim 1, further comprising a disc having an orifice formed therein inserted into one of said first and second fluid inlets.

14. A different pressure switch, comprising:

a snap-action switch;

a housing having two open ends and having electrical connections passing through a wall thereof and connected to said snap action switch arranged within said housing;

a first flat ring diaphragm sealing one of said open ends of said housing;

a second flat ring diaphragm sealing the other of said open ends of said housing, so that said snap-action switch means is sealed in said housing;

strut means connected to said first and second diaphragms and passing through said housing, whereby motion of said first diaphragm is transmitted to said second diaphragm by said strut means;

means for transmitting motion of said strut means to said snap-action switch, wherein said strut means comprises a first disc attached to the center of said first flat ring diaphragm and has a first tube extending from the center thereof into said housing and a second disc attached to the center of said second flat ring diaphragm and has a second tube extending from the center thereof into said housing, said first and second tubes being joined and cooperating with said means for transmitting motion;

first end cover means having a first fluid inlet port and being attached to said housing whereat said first diaphragm forms a first chamber therewith; and second end cover means having a second fluid inlet port and being attached to said housing whereat said second diaphragm forms a second chamber therewith, whereby a fluid pressure differential between said first and second chambers causes movement of said strut means that is transmitted to said snap-action switch.

15. A differential pressure switch according to claim 14, wherein said first and second tubes are joined so as to form a groove therebetween and said means for transmitting motion includes a paddle having an open central area through which said first and second tubes pass and at least one pin extends into said groove.

16. A differential pressure switch according to claim 15, wherein said paddle is connected at one end to an inner wall of said housing by a thin, plastic hinge.

17. A differential pressure switch, according to claim 14, further comprising a spring connected to said strut means and one of said first and second end cover means, said spring biasing said first and second diaphragms in a selected direction.

* * * * *